US005791871A

United States Patent [19]

Sech et al.

[11] Patent Number: 5,791,871

[45] Date of Patent: Aug. 11, 1998

[54] TURBINE ENGINE ROTOR ASSEMBLY BLADE OUTER AIR SEAL

[75] Inventors: John R. Sech, Palm City, Fla.; Patrick H. Ellis, Mountain Home, Id.

[73] Assignee: United Technologies Corporation, Hartford, Conn.

[21] Appl. No.: 769,174

[22] Filed: Dec. 18, 1996

[51] Int. Cl.[6] ..... F04D 29/18

[52] U.S. Cl. ..... 415/173.1

[58] Field of Search ..... 415/170.1, 173.1, 415/174.4

[56] References Cited

U.S. PATENT DOCUMENTS

| | | | |
|---|---|---|---|
| 3,042,365 | 7/1962 | Curtis et al. | 253/39 |
| 3,719,365 | 3/1973 | Emmerson et al. | 277/53 |
| 3,970,319 | 7/1976 | Carroll et al. | 277/53 |
| 4,050,843 | 9/1977 | Needham et al. | 415/116 |
| 4,222,706 | 9/1980 | Ayache et al. | 415/116 |
| 4,466,772 | 8/1984 | Okapuu et al. | 415/172 A |
| 4,526,509 | 7/1985 | Gay, Jr. et al. | 415/174 |
| 4,551,064 | 11/1985 | Pask | 415/116 |
| 4,767,266 | 8/1988 | Holz et al. | 415/172 A |
| 4,781,530 | 11/1988 | Lauterbach et al. | 415/170 R |
| 5,022,816 | 6/1991 | Maier et al. | 415/115 |
| 5,039,562 | 8/1991 | Liang | 427/276 |
| 5,197,853 | 3/1993 | Creevy et al. | 415/115 |
| 5,211,534 | 5/1993 | Catlow | 415/173.002 |
| 5,423,659 | 6/1995 | Thompson | 415/173.1 |

*Primary Examiner*—John T. Kwon

*Attorney, Agent, or Firm*—Richard D. Getz

[57] ABSTRACT

A blade outer air seal for a turbine engine rotor assembly is provided. The rotor assembly includes a plurality of rotor blades extending out from a rotor disk, each blade having an outer radial tip with an axial length. The blade outer air seal includes a hoop-shaped body and apparatus for suspending the body in close proximity to the outer radial tips of the rotor blades. The body includes an inner radial surface and an outer radial surface. According to a first embodiment, the body inner radial surface includes a first slot, a second slot, and a central portion positioned between the first and second slots. The central portion has an axial length equal to or less than the axial length of the rotor blade outer radial tips. According to a second embodiment, the body inner radial surface includes a raised central portion having an axial length equal to or less than the axial length of the rotor blade outer radial tips.

8 Claims, 1 Drawing Sheet

FIG. 1
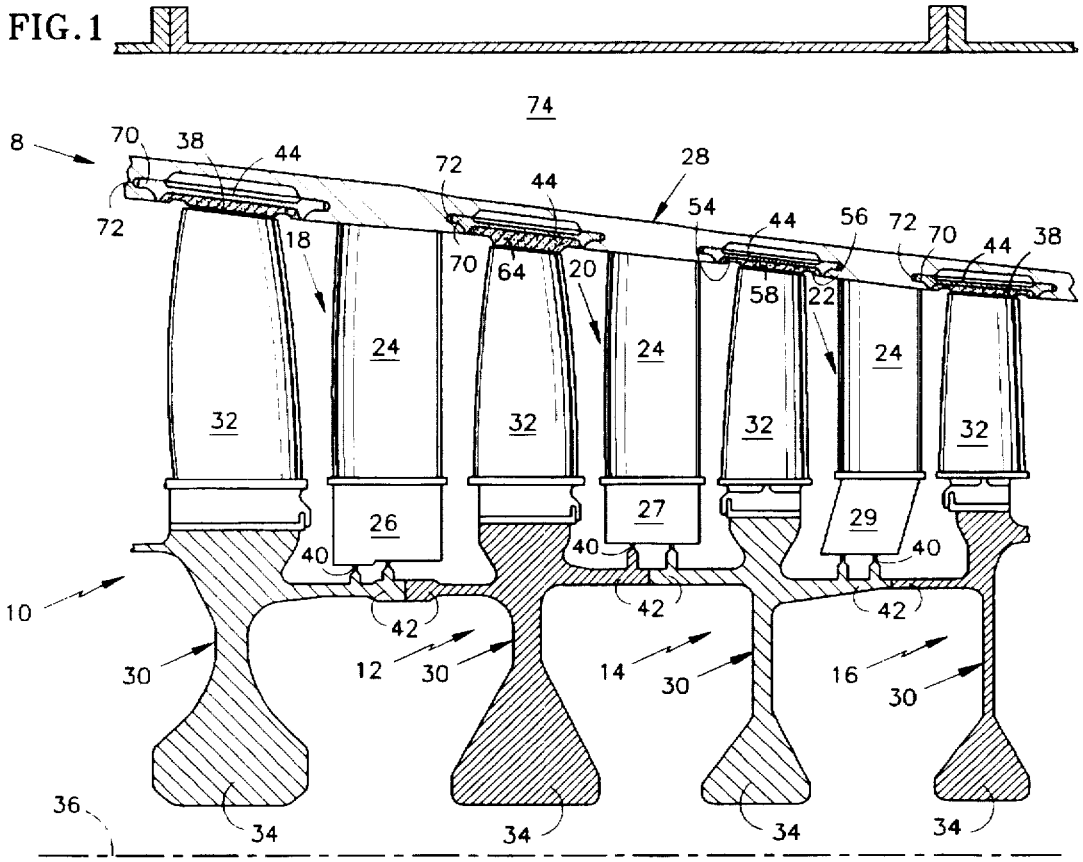
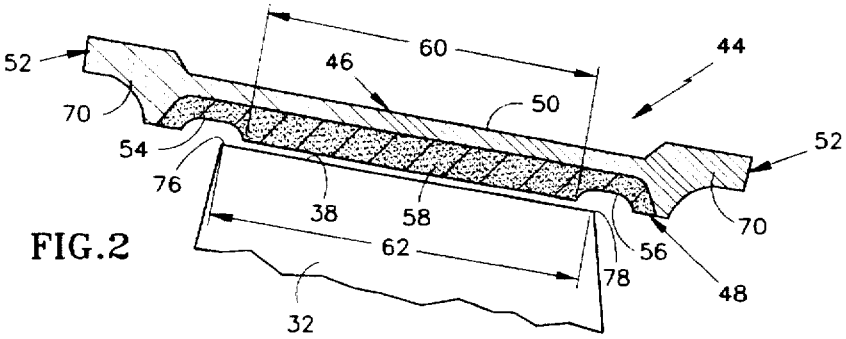
FIG. 2
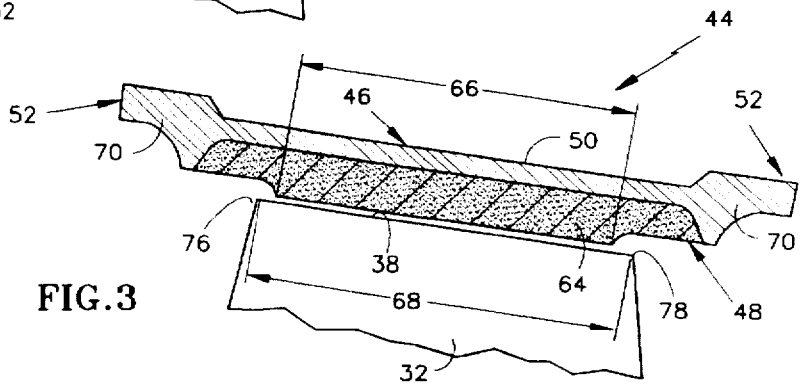
FIG. 3

TURBINE ENGINE ROTOR ASSEMBLY BLADE OUTER AIR SEAL

The invention was made under a U.S. Government contract and the Government has rights herein.

BACKGROUND OF THE INVENTION

1. Technical Field

This invention relates to turbine engine rotor assemblies in general, and to rotor assembly blade outer air seals in particular.

2. Background Information

Axial turbine engines generally include fan, compressor, combustor and turbine sections positioned along an axial centerline sometimes referred to as the engine's "axis of rotation". The fan, compressor, and combustor sections add work to air (also referred to as "core gas") flowing through the engine. The turbine extracts work from the core gas to drive the fan and compressor sections. The fan, compressor, and turbine sections each include a series of stator and rotor assemblies. The stator assemblies, which do not rotate (but may have variable pitch vanes), increase the efficiency of the engine by guiding core gas flow into or out of the rotor assemblies.

Each rotor assembly typically includes a plurality of blades extending out from the circumference of a disk. Platforms extending laterally outward from each blade collectively form an inner radial flowpath boundary for core gas passing through the rotor assembly. An outer case, including blade outer air seals (BOAS), provides the outer radial flow path boundary. The blade outer air seal aligned with a particular rotor assembly is suspended in close proximity to the rotor blade tips to seal between the tips and the outer case. The sealing provided by the blade outer air seal helps to maintain core gas flow between rotor blades where the gas can be worked (or have work extracted).

Disparate thermal growth between the rotor assembly and the outer case can cause the rotor blade tips to "grow" radially and interfere with the aligned blade outer air seal. In some applications, the gap between the rotor blade tips and the blade outer air seal is increased to avoid the interference. A person of skill in the art will recognize, however, that increased gaps tend to detrimentally effect the performance of the engine, thereby limiting the value of this solution. In other applications, the blade outer air seals comprise an abradable material and the blade tips include an abrasive coating to encourage abrading of the blade outer air seals. The blade tips abrade the blade outer air seal until a customized clearance is left which minimizes leakage between the rotor blade tips and the blade outer air seal. A problem with this solution occurs when there is axial movement of the rotor disk and blades. Aberrant conditions within a gas turbine engine can cause a rotor assembly and attached spool to travel axially, thereby changing the position of the rotor assembly relative to the blade outer air seal. If the rotor blade tips are received within an abraded trench, the axial travel can cause side portions of the blade tips to thrust into the sides of the trench. Sufficient axial travel and a deep trench can cause the rotor blade tip comers to fail.

Hence, what is needed is a turbine engine rotor assembly blade outer air seal that effectively minimizes the flow of core gas radially outside the rotor blade tips, and one that accommodates rotor assembly axial travel.

DISCLOSURE OF THE INVENTION

It is, therefore, an object of the present invention to provide a turbine engine rotor assembly blade outer air seal that effectively minimizes the flow of core gas radially outside of the rotor blade tips.

It is another object of the present invention to provide a turbine engine rotor assembly blade outer air seal that accommodates rotor assembly axial travel.

According to the present invention, a blade outer air seal for a turbine engine rotor assembly is provided. The rotor assembly includes a plurality of rotor blades extending out from a rotor disk, each blade having an outer radial tip with an axial-length. The blade outer air seal includes a hoop-shaped body and means for suspending the body in close proximity to the outer radial tips of the rotor blades. The body includes an inner radial surface and an outer radial surface.

According to a first embodiment of the present invention, the body inner radial surface includes a first slot, a second slot, and a central portion positioned between the first and second slots. The central portion has an axial length equal to or less than the axial length of the rotor blade outer radial tips.

According to a second embodiment of the present invention, the body inner radial surface includes a raised central portion having an axial length equal to or less than the axial length of the rotor blade outer radial tips.

An advantage of the present invention is that rotor assembly axial movement can be accommodated and rotor blade damage avoided. In the event rotor blades abrade a trench into the central portion of the present invention blade outer air seal, the first and second slots of the first embodiment provide a relief into which the rotor blades can axially travel without damage. The raised central portion of the second embodiment similarly permits axial travel without interference by providing voids on either side of the raised central portion.

These and other objects, features and advantages of the present invention will become apparent in light of the detailed description of the best mode embodiment thereof, as illustrated in the accompanying drawings.

BRIEF DESCRIPTION OF THE DRAWINGS

FIG. 1 is a diagrammatic view of a gas turbine engine compressor having a plurality of stator and rotor assemblies.

FIG.2 is an enlarged diagrammatic view of one of the blade outer air seals shown in FIG. 1.

FIG.3 is an enlarged diagrammatic view of one of the blade outer air seals shown in FIG. 1.

BEST MODE FOR CARRYING OUT THE INVENTION

Referring to FIG. 1, a gas turbine engine compressor section 8 includes first 10, second 12, third 14, and fourth 16 rotor stages and first 18, second 20, and third 22 stator vane assemblies alternately disposed amongst the rotor stages. Each stator vane assembly 18,20,22 includes a plurality of stator vanes 24 extending between an inner vane support 26,27,29 and an outer case 28 positioned radially outside the vanes 24. The vanes 24 guide core gas into and out of the rotor stages 10,12,14,16.

Each rotor stage 10,12,14,16 includes a rotor assembly 30 having a plurality of rotor blades 32 attached to a disk 34. The rotor blades 32 are spaced around the circumference of the disk 34 and the assembly 30 is rotatable around an axial centerline 36. The outer radial surface 38 of each blade 32 is generally referred to as the "tip" of the blade 32. Knife edge seals 40, attached to arms 42 extending axially out from each disk 34, seal between the rotor stages 10,12,14,16 and the stator vane assemblies 18,20,22.

A plurality of blade outer air seals 44, each aligned with a rotor stage 10,12,14,16, are suspended within the outer case 28. Each blade outer air seal 44 includes a circumferentially segmented hoop-shaped body 46 (see FIGS. 2 and 3). The body 46 includes an inner radial surface 48, an outer radial surface 50, and means 52 for suspending the body 46 in close proximity to the rotor blade tips 38. In a first embodiment (see FIGS. 1 and 2), the inner radial surface 48 includes a first slot 54, a second slot 56 and a central portion 58 positioned between the first 54 and second 56 slots. The first 54 and second 56 slots and the central portion 58 extend around the entire circumference of the inner radial surface 48. The central portion 58 has an axial length 60 equal to or less than the axial length 62 of the rotor blade tips 38. In a second embodiment (see FIGS. 1 and 3), the inner radial surface 48 includes a raised central portion 64 having an axial length 66 equal to or less than the axial length 68 of the rotor blade tips 38. The raised central portion 64 extends around the entire circumference of the inner radial surface 48. The means 52 for suspending the blade outer air seal 44 in close proximity to the rotor blade tips 38 is shown as a plurality of tabs 70 which are received within slots 72 (see FIG. 1) formed in the outer case 28. Other blade outer air seal suspension configurations may be used alternatively.

Referring to FIG. 1, during operation of the engine a portion of the core gas exiting the fan section (not shown) enters the compressor section 8. The remainder of the core gas flow enters the fan duct 74 outside the compressor 8 for use in downstream engine components. The core gas entering the compressor section 8 is worked by the compressor rotor stages 10,12,14,16 to a higher energy level. The high energy core gas exiting the compressor section 8 eventually enters the combustor section (not shown), where fuel is mixed and ignited, thereby further increasing the energy of the core gas.

During transient periods of operation where the thermal response of the rotor stages 10,12,14,16 differs from that of the outer case 28, the rotor blade tips 38 may extend radially outward and engage the central portion 58,64 of the blade outer air seal 44, abrading a percentage of the central portion 58,64. The abrading process allows the rotor blades 32 to customize the clearance between the blade rotor tips 38 and the blade outer air seal 44, and consequently minimize leakage therebetween.

A person of skill will recognize that aberrant conditions within a gas turbine engine can cause a rotor assembly 30 to travel axially. The axial travel, if substantial, can change the position of the rotor assembly 30 relative to the blade outer air seal 44 normally aligned radially outside the rotor assembly 30. The first embodiment of the present invention blade outer air seal 44 accommodates axial movement of the rotor assembly 30 by providing the first 54 and second 56 slots on the axial sides of the central portion 58; i.e., the forward 76 or aft 78 edge of the rotor blade tip 38 travels into the relief provided by the first 54 or second 56 slot, respectively. The second embodiment of the present invention blade outer air seal 44 accommodates axial movement of the rotor assembly 30 by providing voids on both axial sides of the raised central portion 64. Hence, both embodiments avoid the interference (and the potential blade damage) that occurs between the blade tip edges and the sides of the trench formed in conventional blade outer air seals.

Although this invention has been shown and described with respect to the detailed embodiments thereof, it will be understood by those skilled in the art that various changes in form and detail thereof may be made without departing from the spirit and the scope of the invention. For example, the "Best Mode For Carrying The Invention" heretofore describes the present invention in terms of a compressor assembly blade outer air seal. The present invention blade outer air seal 44 may alternatively be used in a fan or turbine application, alternatively.

We claim:

1. A blade outer air seal for a turbine engine rotor assembly, the rotor assembly including a plurality of rotor blades extending out from a rotor disk, each blade having an outer radial tip with an axial length, wherein the blade outer air seal comprises:

a hoop-shaped body, having inner and outer radial surfaces, wherein said inner radial surface includes a first slot, a second slot, and a central portion positioned between said first and second slots, wherein said central portion has an axial length equal to or less than the axial length of the rotor blade outer radial tips; and means for suspending said body in close proximity to the rotor blade outer radial tips, attached to said body.

2. A blade outer air seal according to claim 1, wherein said hoop-shaped body is circumferentially segmented, and each said segment includes means for attaching to adjacent segments, thereby collectively forming said hoop shape.

3. A turbine engine rotor assembly, comprising:

a rotor disk, rotatable around an axial centerline;

a plurality of rotor blades, extending out from said rotor disk, each blade having an outer radial tip with a first axial length; and a blade outer air seal, having a hoop-shaped body with inner and outer radial surfaces, wherein said inner radial surface includes a first slot, a second slot, and a central portion positioned between said first and second slots, wherein said central portion has a second axial length equal to or less than said first axial length of said rotor blade outer radial tips; and means for suspending said blade outer air seal in close proximity to said rotor blade outer radial tips, attached to said body;

wherein said rotor disk and attached blades are received within said blade outer air seal.

4. A turbine engine rotor assembly according to claim 3, wherein said hoop-shaped body is circumferentially segmented and each said segment includes means for attaching to adjacent segments, thereby collectively forming said hoop shape.

5. A blade outer air seal for a turbine engine rotor assembly, the rotor assembly including a plurality of rotor blades extending out from a rotor disk, each blade having an outer radial tip with an axial length, wherein the blade outer air seal comprises:

a body, having a hoop shape with an inner radial surface and an outer radial surface, wherein said inner radial surface includes a raised central portion having an axial length equal to or less than the axial length of the rotor blade outer radial tips; and means for suspending said central portion of said body in close proximity to the rotor blade outer radial tips.

6. A blade outer air seal according to claim 5, wherein said hoop-shaped body is circumferentially segmented, and each said segment includes means for attaching to adjacent segments, thereby collectively forming said hoop shape.

7. A turbine engine rotor assembly, comprising:

a rotor disk, rotatable about an axial centerline;

a plurality of rotor blades, extending out from said rotor disk, each blade having an outer radial tip with a first axial length;

a blade outer air seal, having a hoop-shaped body with an inner radial surface and an outer radial surface, wherein said inner radial surface includes a central portion having a second axial length equal to or less than said first axial length of said rotor blade outer radial tips; and means for suspending said central portion of said blade outer air seal in close proximity to said rotor blade outer radial tips;

wherein said rotor disk and attached blades are received within said blade outer air seal.

8. A turbine engine rotor assembly according to claim 7, wherein said hoop-shaped body is circumferentially segmented and each said segment includes means for attaching to adjacent segments, thereby collectively forming said hoop shape.

* * * * *